US008277015B2

(12) United States Patent
Fujikura

(10) Patent No.: US 8,277,015 B2
(45) Date of Patent: Oct. 2, 2012

(54) IMAGE FORMING DEVICE

(75) Inventor: Tatsuo Fujikura, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 282 days.

(21) Appl. No.: 12/716,885

(22) Filed: Mar. 3, 2010

(65) Prior Publication Data

US 2010/0225695 A1 Sep. 9, 2010

(30) Foreign Application Priority Data

Mar. 9, 2009 (JP) ..... 2009-055462

(51) Int. Cl.
*B41J 16/38* (2006.01)
*B41J 2/01* (2006.01)

(52) U.S. Cl. ..... 347/16; 347/17; 347/102

(58) Field of Classification Search ..... None
See application file for complete search history.

(56) References Cited

U.S. PATENT DOCUMENTS

| | | | | |
|---|---|---|---|---|
| 5,771,054 | A | 6/1998 | Dudek et al. | |
| 2007/0200888 | A1 * | 8/2007 | Inoue et al. | 347/16 |

FOREIGN PATENT DOCUMENTS

| | | | | |
|---|---|---|---|---|
| EP | 0423820 | A2 | | 4/1991 |
| EP | 1384593 | A2 | | 1/2004 |
| JP | 8-323977 | A | | 12/1996 |
| JP | 11-179889 | A | | 7/1999 |
| JP | 2002-347226 | A | | 12/2002 |
| JP | 2002347226 | A | * | 12/2002 |
| JP | 2003-211652 | A | | 7/2003 |

* cited by examiner

*Primary Examiner* — Stephen Meier
*Assistant Examiner* — Alexander C Witkowski
(74) *Attorney, Agent, or Firm* — Birch, Stewart, Kolasch & Birch, LLP

(57) ABSTRACT

Blocking members are respectively provided at a conveyance direction upstream side and downstream side of a head unit of an inkjet recording device. The two blocking members are provided radially extending from an area near an outer peripheral surface of an image formation drum, and extend across a width direction of a paper, and respectively cover both conveyance direction sides of the head unit. An end of each blocking member near to the image formation drum is separated from the outer peripheral surface of the drum by a predetermined distance. Between an inkjet line head and a blocking member is provided a fan that blows air along a droplet ejection direction towards a vicinity of the outer peripheral surface of the image formation drum, thereby preventing heat from the image formation drum from being transmitted to an ejection direction distal end of the inkjet line head.

13 Claims, 4 Drawing Sheets

IMAGE FORMING DEVICE

CROSS-REFERENCE TO RELATED APPLICATION

This application claims priority under 35 USC 119 from Japanese Patent Application No. 2009-055462, filed on Mar. 9, 2009, the disclosure of which is incorporated by reference herein.

BACKGROUND OF THE INVENTION

1. Field of the Invention

The present invention relates to an image forming device.

2. Description of the Related Art

Conventionally, when printing aqueous ink on a general-use paper P with an inkjet recording device, in order to prevent water in the ink from permeating into a base sheet of paper P in order to create a high quality image, it has been necessary to dry a printing surface instantly.

As general methods of drying the printing surface, the paper P may be heated, or heated air may be blown thereon, or the like. In order to perform drying soon after drawing an image, paper P may be suctioned at a heated stage and heated air may be blown thereon immediately following drawing of the image.

As an example of such a method, Japanese Patent Application Laid-Open (JP-A) No. 2002-347226 discloses a configuration of an inkjet printer that uses an ink drying method in which the back of a paper P is heated at a paper P conveyance direction upstream position and a paper P conveyance direction downstream position with respect to a line inkjet head, and a recording surface is heated and dried in a non-contact manner at a downstream position with respect to the line inkjet head.

Further, a configuration of an inkjet printer is disclosed in JP-A No. 8-323977 in which a drum that holds and conveys paper P is a heated drum.

However, in the configuration of JP-A No. 2002-347226, when the ink is dried immediately following ink ejection in order to improve ink drying performance, it is necessary to move a drying unit close to an ink ejection unit.

As a result, heat or heated air generated by the drying may reach an ejection surface of the inkjet head, and ink may dry at a nozzle, or a temperature at the nozzle head may increase, which may result in problems such as unstable ink ejection characteristics.

Similarly, in the configuration of JP-A No. 8-323977, heat or heated air is transmitted to an inkjet head, and as a result, when the temperature of a heated drum is increased in order to improve ink drying performance, problems may occur such as a decrease in stability of ink ejection characteristics at a time of ink droplet ejection.

SUMMARY OF THE INVENTION

In consideration of the above issues, the present invention provides an image forming device that can perform ink droplet drying while suppressing negative effects on the stability of ink droplet ejection characteristics.

A first aspect of the present invention is an image forming device, including: a conveyance stage that holds a recording medium at a holding surface and conveys the recording medium; a droplet ejection head provided opposing the holding surface; a first air blowing device that blows air along a droplet ejection direction of the droplet ejection head, and a second air blowing device, provided further to a conveyance direction downstream side than the droplet ejection head and opposing the holding surface, that blows heated air.

In the image forming device according to the first aspect of the present invention, when air blown from a second air blowing device dries ink droplets ejected onto a recording medium, air blown from a first air blowing device along an droplet ejection direction pushes back air blown from the second air blowing device; thereby it is possible to prevent negative effects on an ejection surface of an droplet ejection head.

In the first aspect of the present invention, a first blocking member that extends along a droplet ejection direction may be provided at a downstream side of the droplet ejection head in a conveyance direction, such that the blocking member blocks an area between the droplet ejection head and the second air blowing device.

In the above configuration, since the first blocking member blocks an area between the droplet ejection head and the second air blowing device, it is possible to prevent negative effects of air blown from the second air blowing device on an ejection surface of the droplet ejection head.

The image forming device according to the first aspect of the present invention may be provided with a second blocking member disposed along a droplet ejection direction at an upstream side of the droplet ejection head in a conveyance direction.

In the above configuration, since an upstream side of the droplet ejection head in a conveyance direction is blocked by the second blocking member, the vicinity of the droplet ejection head can be blocked by the first and second blocking members, thereby creating a positive pressure with respect to a surrounding area. As a result, it is possible to prevent negative effects on an ejection surface by air blown from a second air blowing device.

In the image forming device according to the first aspect of the present invention, the space between the first blocking member and the holding surface may be larger than the space between the second blocking member and the holding surface.

By the above configuration, it is possible to further increase the air pressure in a vicinity of a droplet ejection head at an upstream side in a conveyance direction, by decreasing the distance from a blocking member to the holding surface at an upstream side in a conveyance direction and increasing the distance from a blocking member to the holding surface at a downstream side. As a result, it is possible to prevent negative effects on an ejection surface by air blown from a second air blowing device.

In the image forming device according to the first aspect of the present invention, the first air blowing device may be provided between the droplet ejection head and the first blocking member.

In the above configuration, air pressure in the vicinity of the droplet ejection head can be further increased, and as a result it is possible to prevent negative effects on an ejection surface by air blown from a second air blowing device.

In the image forming device according to the first aspect of the present invention, the first air blowing device may be provided between the droplet ejection head and the second blocking member.

In the above configuration, air pressure in the vicinity of the droplet ejection head can be further increased, and as a result it is possible to prevent negative effects on an ejection surface by air blown from a second air blowing device.

The image forming device according to the first aspect of the present invention may include plural droplet ejection heads arranged along a conveyance direction, with at least one first air blowing device disposed between the droplet ejection heads.

In the above configuration, it is possible to further increase air pressure in the vicinity of plural droplet ejection heads in an image forming device provided with plural droplet ejection heads, and as a result it is possible to prevent negative effects on an ejection surface by air blown from a second air blowing device.

The image forming device according to the first aspect of the present invention may include plural first air blowing devices, in which one first air blowing device provided at a downstream side has a larger blowing strength than another first air blowing device provided at an upstream side.

In the above configuration, air pressure in the vicinity of a droplet ejection head can be further increased at an upstream side, and as a result it is possible to prevent negative effects on an ejection surface by air blown from a second air blowing device.

In the image forming device according to the first aspect of the present invention, the stage may include a roller provided with a heating member that heats the holding surface.

In the above configuration, by using a roller provided with a heating member as the stage, the recording medium may be heated from the stage side, and air blown from a first air blowing device may prevent negative effects on an ejection surface, while drying the liquid droplets.

In the image forming device according to the first aspect of the present invention, the stage may be provided with a cover member that covers a recessed portion of an outer peripheral surface of the stage.

In the above configuration, since a recessed portion of an outer peripheral surface of the stage is covered by a cover member, it is possible to prevent heated air at the recessed portion from being retained, thereby preventing negative effects on a droplet ejection head by heat from the stage.

Since the present invention has the above configuration, it is possible to provide an image forming device that can perform ink droplet drying while suppressing negative effects on the stability of ink ejection performance.

BRIEF DESCRIPTION OF THE DRAWINGS

FIG. 4A shows an example of a conventional image forming device, and FIG. 4B shows the image forming device according to an embodiment of the present invention.

DETAILED DESCRIPTION OF THE INVENTION

Next, an exemplary embodiment of the present invention will be explained with reference to the drawings.

<Overall Configuration>

Figure 1:
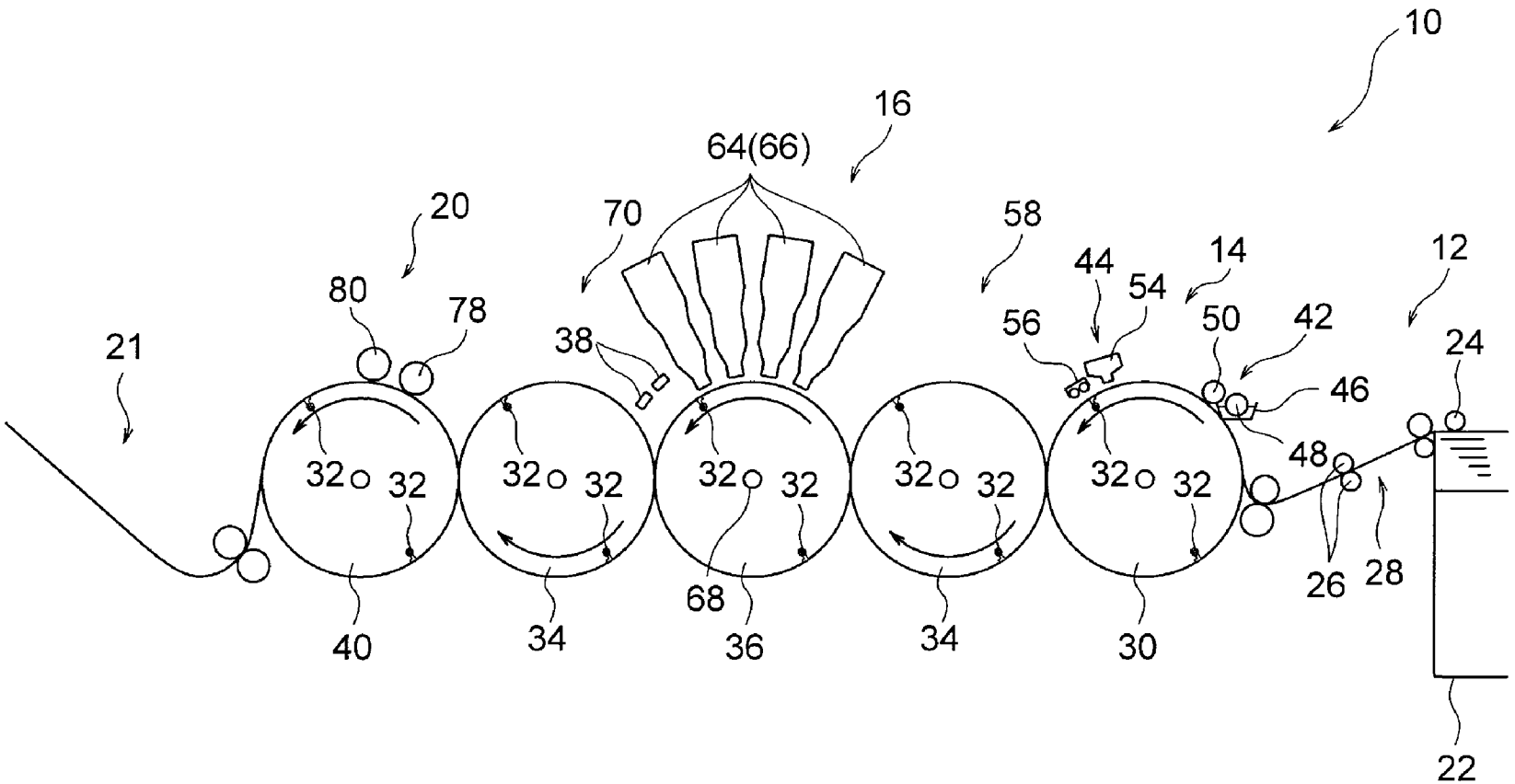
FIG. 1 is a schematic view showing the main portions of the image forming device according to an embodiment of the present invention.

As shown in FIG. 1, image forming device 10 according to the present embodiment is provided with a paper supply and conveyance section 12, that supplies and conveys a paper P, which is a recording medium, at an upstream side in a conveyance direction of paper P. At a downstream side of paper supply and conveyance section 12, are provided, in the following order in a conveyance direction of paper P, a processing liquid application section 14 that applies a processing liquid to a recording surface of paper P, an image formation section 16 that forms an image on a recording surface of paper P, an image fixing section 20 that fixes a dried image to paper P, and an ejection section 21 that ejects paper P to which the image has been fixed. Each of these processing sections is explained below.

<Paper Supply and Conveyance Section>

Paper supply and conveyance section 12 includes a stacking section 22 at which paper P is stacked, and, at a paper conveyance direction downstream side of stacking section 22, a paper supply section 24 that supplies paper P stacked at stacking section 22 one sheet at a time. Paper P supplied by paper supply section 24 is conveyed by a conveyance section 28 provided with plural pairs of rollers 26 to processing liquid application section 14.

<Processing Liquid Application Section>

A processing liquid application drum 30 is rotatably provided at processing liquid application section 14. A holding member 32 that holds paper P by gripping a leading end portion of paper P is provided at processing liquid application drum 30. Paper P is held at a surface of processing liquid application drum 30 by holding member 32 and in this state is conveyed in a downstream direction by the rotation of processing liquid application drum 30.

An intermediate conveyance drum 34 explained below, as well as an image formation drum 36 and an image fixing drum 40 are also provided with a holding member 32 similar to processing liquid application drum 30. Paper P is passed from the upstream drums to the downstream drums by holding members 32.

At an upper portion of processing liquid application drum 30, along a peripheral direction of processing liquid application drum 30, is provided a processing liquid application device 42 and a processing liquid drying device 44. Processing liquid is applied to a recording surface of paper P by processing liquid application device 42, and the processing liquid is dried by processing liquid drying device 44.

The processing liquid reacts with the ink and causes the colorant (pigment) to aggregate, thereby promoting the separation of the colorant (pigment) and a solvent. At processing liquid application device 42 is provided a reservoir section 46 at which processing liquid is stored, and a gravier roller 48 is partially immersed in processing liquid.

A rubber roller 50 is provided at and presses against gravier roller 48. Rubber roller 50 contacts a recording surface (face) side of paper P and processing liquid is thereby applied. A squeegee (not shown) contacts gravier roller 48 and controls the application amount of processing liquid applied to the recording surface of paper P.

At processing liquid drying device 44 is provided a heated air nozzle 54 and an infrared heater 56 (hereinafter also referred to as "IR heater 56") near to the surface of processing liquid application drum 30. Processing liquid is applied to the recording surface at processing liquid application section 14, and paper P is dried, and then conveyed to an intermediate conveyance section 58 provided between processing liquid application section 14 and image formation section 16.

<Intermediate Conveyance Section>

Intermediate conveyance drum 34 is rotatably provided at intermediate conveyance section 58, and an edge portion of paper P is held at a surface of intermediate conveyance drum 34 by a holding member 32 provided at intermediate conveyance drum 34. Paper P is conveyed downstream by the rotation of intermediate conveyance drum 34.

<Image Formation Section>

Image formation drum 36 is rotatably provided at image formation section 16, and paper P is held at a surface of image formation drum 36 by a holding member 32 provided at image formation drum 36. Paper P is conveyed downstream by the rotation of image formation drum 36.

At an upper portion of image formation drum 36, is provided a head unit 66 including a single pulse inkjet line head 64 near to an outer peripheral surface of image formation drum 36. At head unit 66, inkjet line head 64, having at least the basic colors YMCK, is arranged along a peripheral direction of image formation drum 36, such that an image of various colored droplets may be formed on paper P.

A heater 37 is provided at a separate location opposing the outer peripheral surface of image formation drum 36. Heater 37 heats image formation drum 36 from an outer side, and, as indicated by arrow H, the temperature of image formation drum 36 itself increases, and paper P is thereby maintained at a specific temperature or greater while being held at the outer peripheral surface, such that the water content of paper P may be controlled.

Inkjet line head 64 performs droplet ejection synchronized with an encoder (not shown) that is provided at image formation drum 36 and that detects a rotation speed. Thereby, it is possible to determine droplet impact position with high accuracy, and to reduce inconsistencies in droplet ejection regardless of the movement of image formation drum 36, the accuracy of a rotation axle 68 or a drum surface speed.

Head unit 66 can be retracted from an upper portion of image formation drum 36, and operations of cleaning a nozzle surface of inkjet line head 64 and discharging viscous ink may be performed by retracting head unit 66 from an upper portion of image formation drum 36.

Paper P, having an image formed at a recording surface thereof, is conveyed by the rotation of image formation drum 36 to an intermediate conveyance section 70 provided between image formation section 16 and ink drying section 18. Since the configuration of intermediate conveyance section 70 is substantially similar to that of intermediate conveyance section 58, description thereof is omitted here.

<Dryer>

At a downstream side of head unit 66, at least one dryer 38 is provided at a location opposing an outer peripheral surface of image formation drum 36. Dryer 38 is provided with a nozzle 72 and a fan heater 74. Heated air from nozzle 72 and fan heater 74 dries a solvent at an image formation portion at paper P, which has been separated as a result of dye aggregation, thereby forming a thin film image layer. The temperature of the heated air may vary according to the conveyance speed of paper P, but it is generally set to from around 50° C. to around 70° C.

Evaporated solvent may be discharged together with air from an outer portion of image forming device 10, or the air may be collected, and the air including evaporated solvent may be cooled by a cooling device or the like, and the solvent may be condensed and collected in a liquid state by a radiator or the like.

Paper P, having an image formed at a recording surface thereof, is conveyed to image fixing section 20 by the rotation of intermediate conveyance drum 34.

<Image Fixing Section>

An image fixing drum 40 is rotatably provided at image fixing section 20. Image fixing section 20 has a function whereby it imparts heat and pressure to latex particles in the thin film image layer formed on paper P such that the latex particles are melted and thereby fixed on paper P.

At an upper portion of image fixing drum 40 near to a surface of image fixing drum 40 is provided a heat roller 78. Heat roller 78 includes a halogen lamp inside a metal tube made of a material with good heat conductivity, such as aluminum. Heat energy at or above a temperature Tg (melting temperature) of the latex is applied by heat roller 78. As a result, the latex particles melt, and are pressed and fixed into surface irregularities on paper P; thereby, irregularities at an image surface may be smoothed, and glossiness may be improved.

At a downstream side of heat roller 78 is provided a fixing roller 80. Fixing roller 80 is provided to push against a surface of image fixing drum 40, such that a nipping force may be obtained between fixing roller 80 and image fixing drum 40. To this end, a surface of at least one of fixing roller 80 or image fixing drum 40 has elasticity, and is configured to have a uniform nip width with respect to paper P.

After the above processes, paper P, having an image fixed at a recording surface thereof is conveyed by the rotation of image fixing drum 40 to an ejection section 21 provided at a downstream side of image fixing section 20.

In the present embodiment, image fixing section 20 has been described. However, a configuration in which an image formed at a recording surface is dried and fixed at dryer 38 is also possible, and image fixing section 20 is not essential.

<Area Around Dryer and Head Unit>

Figure 2:
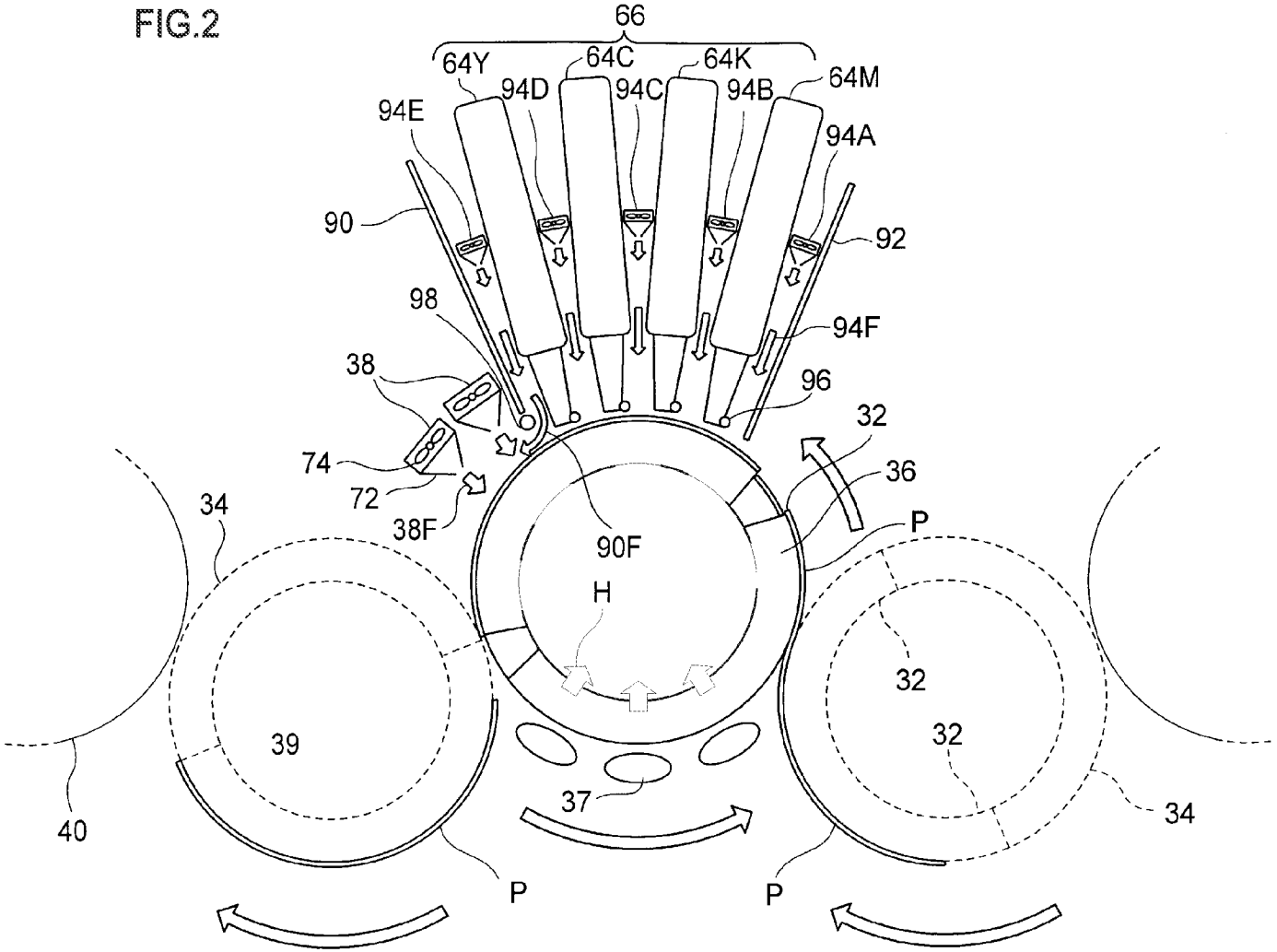
FIG. 2 is a enlarged side view showing the structure of the image forming device shown in FIG. 1.
Figure 3:
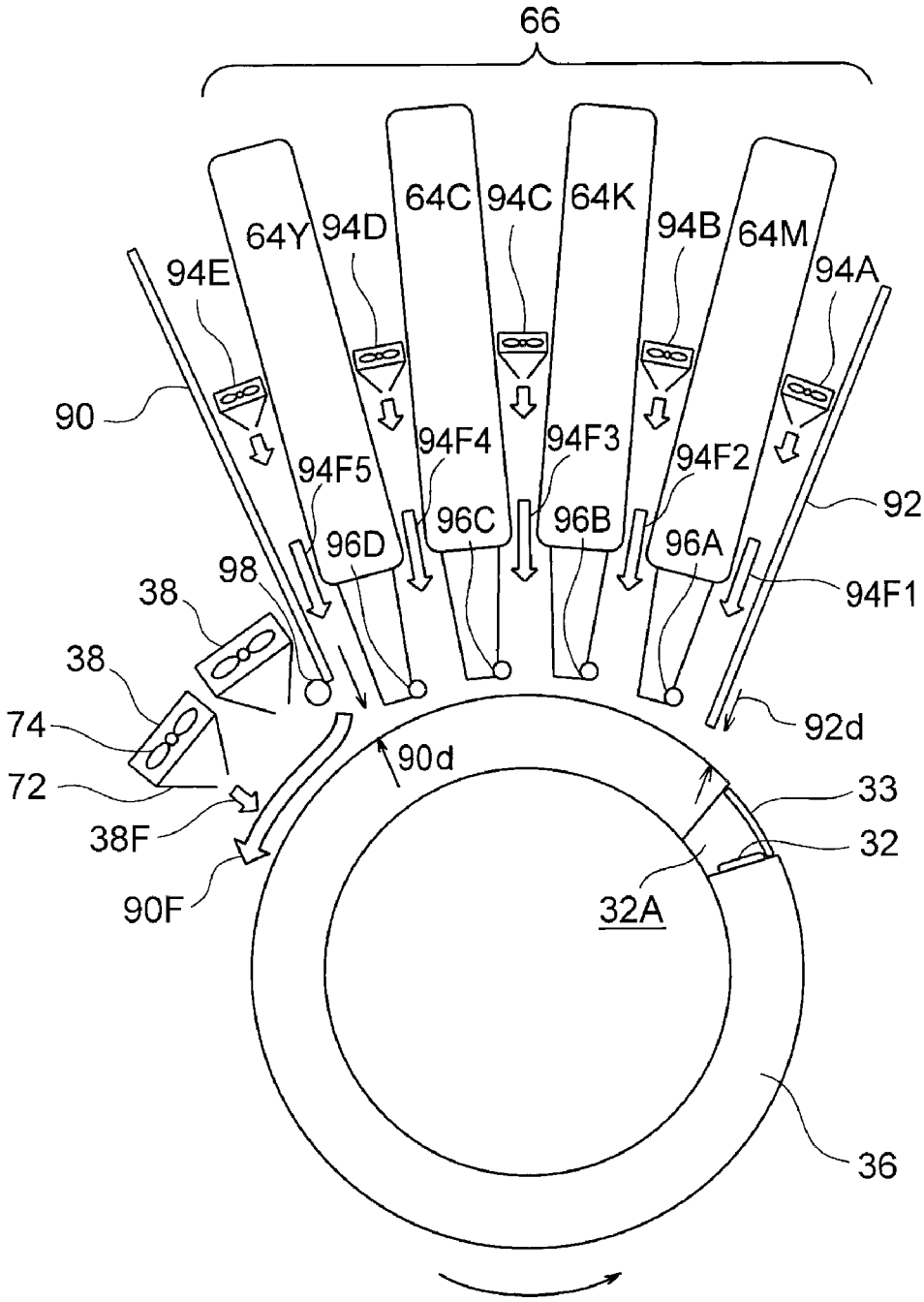
FIG. 3 is a enlarged side view showing the structure of the image forming device shown in FIG. 2.

The image forming device according to the present embodiment, as shown enlarged in FIGS. 2 and 3, is provided with a structure around a dryer and head unit.

As shown in FIGS. 2 and 3, head unit 66 is provided with a blocking member 92 at a conveyance direction upstream side, and a blocking member 90 at a conveyance direction downstream side. Blocking member 92 and blocking member 90 are each provided radially extending from an area near an outer peripheral surface of image formation drum 36 that holds conveys paper P. Blocking member 92 and blocking member 90 each extend in a width direction of paper P, and respectively cover head unit 66 at both conveyance direction sides thereof.

As shown in FIG. 3, an end at a side of blocking member 92 near image formation drum 36, which is provided at a conveyance direction upstream side, is separated from the outer peripheral surface of image formation drum 36 only by distance 92*d*. Between blocking member 92 and an inkjet line head 64M which is farthest towards a conveyance direction upstream side is provided a fan 94A.

Fan 94A, as shown by arrow 94F1, blows air along a droplet ejection direction towards an area near an outer peripheral surface of image formation drum 36, such that heat from image formation drum 36 is not readily transferred to a distal end in an ejection direction of inkjet line head 64M.

A distal end in an ejection direction of inkjet line head 64M may be provided with a temperature sensor 96A. A temperature sensed at temperature sensor 96A may be sent as temperature data to a control section (not shown), and based on the temperature data, the control section may control fan 94A to be ON or OFF such that a temperature at an area near a distal end in an ejection direction of inkjet line head 64M does not exceed a predetermined temperature.

A fan 94B is provided at a conveyance direction downstream side of inkjet line head 64M, and blows air in the direction of arrow 94F2, along a liquid droplet ejection direction towards a vicinity of an outer peripheral surface of image formation drum 36. This configuration is such that heat from image formation drum 36 is not readily transmitted to a distal end in an ejection direction of inkjet line head 64M and inkjet line head 64K, which is adjacent thereto on a conveyance direction downstream side thereof.

A distal end in an ejection direction of inkjet line head 64K may be provided with a temperature sensor 96B similar to inkjet line head 64M. Based on temperature data obtained by temperature sensor 96B, a control section (not shown) may control fan 94B to be ON or OFF such that a temperature at an area near a distal end in an ejection direction of inkjet line head 64K does not exceed a predetermined temperature. Alternatively, in addition to temperature data from temperature sensor 96B, a configuration may be adopted in which, for example, temperature data is compared with temperature data from the adjacent temperature sensor 96A, and fan 94B is controlled taking into account the overall temperature of head unit 66.

In a similar manner, between inkjet line head 64K and inkjet line head 64C which is adjacent thereto at a conveyance direction downstream side, is provided a fan 94C, and between inkjet line head 64C and inkjet line head 64Y which is adjacent thereto at a conveyance direction downstream side is provided a fan 94D.

At a conveyance direction downstream side of inkjet line head 64Y, which is provided furthest at a conveyance direction downstream side, is provided a fan 94E, that blows air in the direction of arrow 94F5, along a liquid droplet ejection direction towards a vicinity of an outer peripheral surface of image formation drum 36.

At a conveyance direction downstream side of fan 94E is provided blocking member 90. Similar to blocking member 92, blocking member 90 is provided radially extending from an area near an outer peripheral surface of image formation drum 36, and extends across a width direction of paper P, and covers head unit 66 at a conveyance direction downstream side thereof.

An end of blocking member 90 at a side near image formation drum 36 is separated from an outer peripheral surface of image formation drum 36 only by distance 90*d*. This distance may be substantially the same as distance 92*d* from blocking member 92 to the outer peripheral surface of image formation drum 36, or distance 92*d* may be smaller than distance 90*d* (92*d*<90*d*).

If distance 92*d* is smaller than distance 90*d*, air readily passes in the direction of arrow 90F, between image formation drum 36 and blocking member 90, which is further downstream than blocking member 92, which is at a conveyance direction upstream side. Thereby, heat from dryer 38, described below, can be effectively blocked from head unit 66.

At a conveyance direction downstream side of blocking member 90 is provided a dryer 38 including nozzle 72 and fan heater 74. Air blown by nozzle 72 in the direction of arrow 38F flows along an outer peripheral surface of image formation drum 36, and a part thereof passes through a gap (90*d*) between blocking member 90 and the outer peripheral surface of image formation drum 36 and blows towards a head unit 66 side.

When an air flow amount sensor 98 provided at an end of blocking member 90 near to image formation drum 36 detects an air flow blowing towards the head unit 66 side, a control section (not shown) operates fans 94A to 94E, thereby applying a positive pressure to the gap between blocking member 90 and blocking member 92 that is greater than that of the surrounding area, and blows out air in the direction of arrow 90F. As a result, in this configuration, control is performed such that air carrying heat from dryer 38 does not enter the head unit 66 side.

Dryer 38 may be a blowing device similar to fans 94A to 94E, instead of fan heater 74. In this case, air heated by the heated image formation drum 36 may be prevented from blowing to a head unit 66 side through a gap (90*d*) between blocking member 90 and an outer peripheral surface of image formation drum 36.

The above described fans 94A to 94E may all be the same type of fan and blow the same amount of air, or different amounts of air may be respectively blown thereby; for example, the amount of air blown may increase from a conveyance direction upstream side to a conveyance direction downstream side.

In other words, by applying a greater positive pressure to an area in the vicinity of head unit 66 than that at a conveyance direction upstream side, air is more readily blown in the direction of arrow 90F, and due to air blowing along a conveyance direction, a surface of paper P that has been heated by heat from image formation drum 36 may be cooled.

<Configuration of Image Formation Drum>

As shown in FIG. 3, at an outer peripheral surface of image formation drum 36, is provided holding member 32 that holds paper P by gripping a leading end portion of paper P, and paper P is conveyed towards a downstream side via holding member 32.

Holding member 32 is provided with a recessed portion 32A provided at an outer peripheral surface of image formation drum 36, and a cover 33 that covers recessed portion 32A and forms an integrated surface with image formation drum 36. Due to cover 33 sealing recessed portion 32A, recessed portion 32A is prevented from holding and retaining air which has been heated by image formation drum 36, whereby heat may be prevented from being transmitted to an area in the vicinity of head unit 66.

<Overall Size of the Device>

Figure 4A:
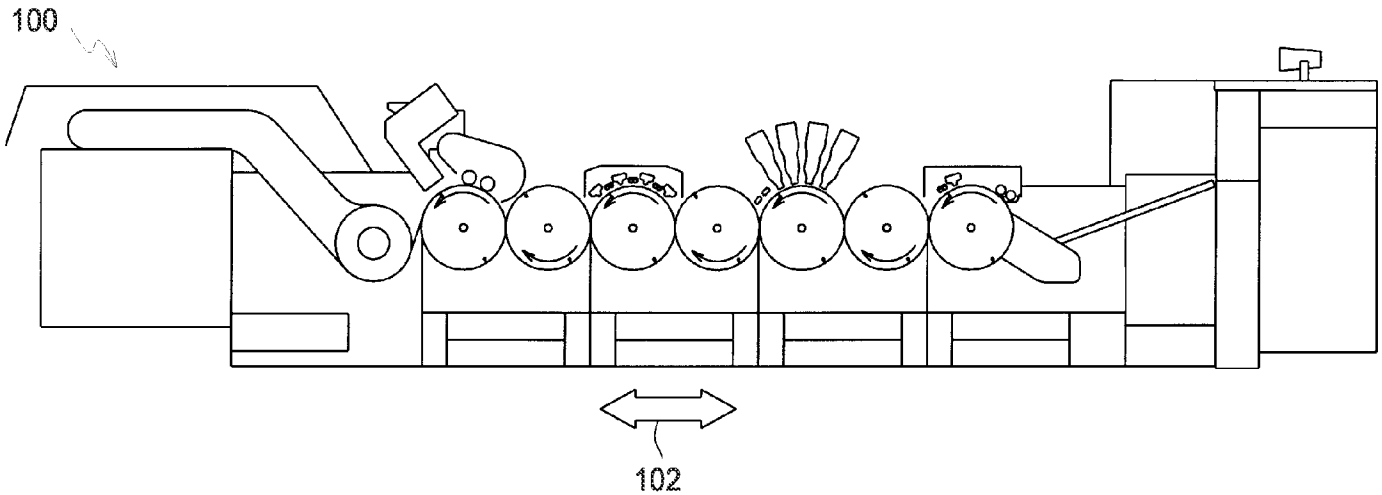
FIGS. 4A and 4B are schematic views showing the overall configuration of two image forming devices.
Figure 4B:
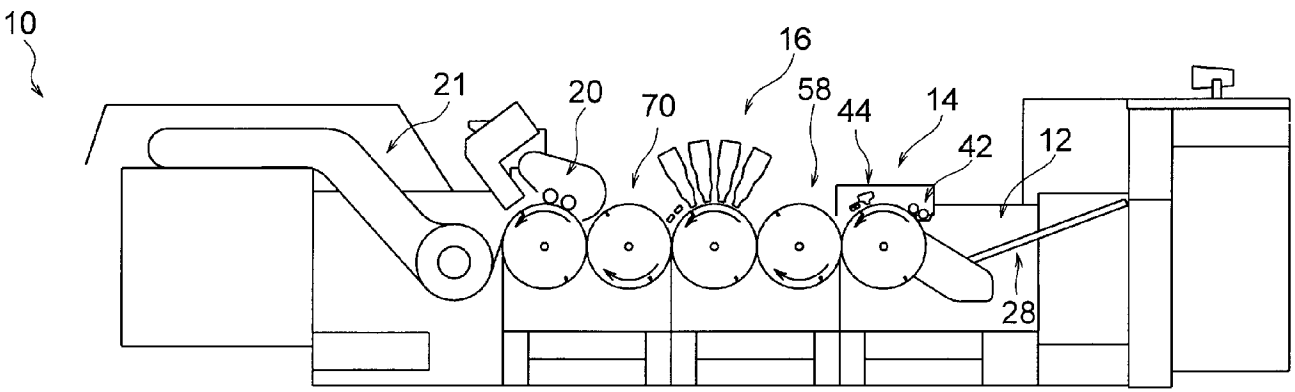

As shown in FIGS. 4A and 4B, the overall configuration of the image forming device of the present invention according to the present embodiment may be comparatively small, compared to a case in which the present configuration is not adopted.

That is, a conventional image forming device 100 as shown in FIG. 4A provides a separate device as a section corresponding to dryer 38 in the present embodiment of the present invention (see arrow 102), and as a result the size thereof in the conveyance direction increases to the length shown by arrow 102.

In contrast, since in image forming device 10 shown in FIG. 4B according to the present embodiment of the present invention, paper P is dried by dryer 38, there is no need to provide a section corresponding to arrow 102 of the conventional art shown in FIG. 4A, and it is therefore possible to reduce the overall size of the device.

<Other Features>

Although the above describes an embodiment of the present invention, the present invention is not limited to the above-described embodiment, and may be implemented in various embodiments provided that these embodiments do not depart from the gist of the invention.

For example, in the above embodiment, paper P is held at a surface of a drum and conveyed. However, the present invention is not limited to this embodiment, and, for example, a configuration that uses an endless belt as a conveyer belt, or a configuration in which a paper is conveyed using a flat plate-like stage, may be used in the present invention.

In the above embodiment, paper P is coated with processing liquid by processing liquid application section 14, and following a drying process, droplet ejection is performed with respect to paper P by head unit 66. However, the present invention is not limited to this embodiment, and, for example, a standard ink jet printer may be used in the present invention, in which plain paper is held and conveyed as is, and droplets are directly ejected to the surface thereof, thereby forming an image.

The ejected liquid of the present invention is also not limited to ink, and may, for example, be used to form substrate patterns during etching.

What is claimed is:

1. An image forming device, comprising:

a conveyance stage that holds a recording medium at a holding surface and conveys the recording medium;

a droplet ejection head provided opposing the holding surface;

a first air blowing device that blows air along a droplet ejection direction of the droplet ejection head, and a second air blowing device, provided further to a conveyance direction downstream side than the droplet ejection head and opposing the holding surface, that blows heated air, wherein the first blowing device is provided further to a conveyance direction upstream side than the second blowing device.

2. The image forming device of claim 1, further comprising a first blocking member, provided along a droplet ejection direction of the droplet ejection head and further to a conveyance direction downstream side than the droplet ejection head, which blocks between the droplet ejection head and the second air blowing device.

3. The image forming device of claim 2, further comprising an air flow amount sensor near an end of the first blocking member that is near to the holding surface, wherein the operation of the first air blowing device is controlled based on an air flow direction detected by the air flow amount sensor.

4. The image forming device of claim 2, wherein the first air blowing device is provided between the droplet ejection head and the first blocking member.

5. The image forming device of claim 1, further comprising a second blocking member provided along a droplet ejection direction of the droplet ejection head and further to a conveyance direction upstream side than the droplet ejection head.

6. The image forming device of claim 5, wherein a distance between the first blocking member and the holding surface is larger than a distance between the second blocking member and the holding surface.

7. The image forming device of claim 5, wherein the first air blowing device is provided between the droplet ejection head and the second blocking member.

8. The image forming device of claim 1, further comprising:

one or more other droplet ejection heads, adjacent to the droplet ejection head, and provided in a row along the conveyance direction; and one or more first air blowing devices provided between the droplet ejection heads.

9. The image forming device of claim 1, wherein at least one further first air blowing device is provided, and an amount of air blown by a first air blowing device provided at a conveyance direction downstream side is larger than an amount of air blown by a first air blowing device provided at a conveyance direction upstream side.

10. The image forming device of claim 1, wherein the stage comprises a roller provided with a heating member that heats the holding surface.

11. The image forming device of claim 10, wherein a portion of an outer peripheral surface of the roller is formed with a recess, and a cover member is provided that covers the recess.

12. The image forming device of claim 1, further comprising a temperature sensor at an area near an ejection opening distal end of the droplet ejection head, wherein the operation of the first air blowing device is controlled based on a temperature of the area near an ejection opening distal end of the droplet ejection head detected by the temperature sensor.

13. The image forming device of claim 1, further comprising:

a first blocking member provided at a conveyance direction downstream side of the droplet ejection head and along a droplet ejection direction, which blocks between the droplet ejection head and the second air blowing device, and a second blocking member provided at a conveyance direction upstream side of the droplet ejection head and along a droplet ejection direction, wherein the operation of the first air blowing device is controlled such that the air pressure at a space near to the holding surface and between the first blocking member and the second blocking member has a positive pressure with respect to an outside of the space.

* * * * *